US011668227B2

(12) United States Patent
Sarder et al.

(10) Patent No.: US 11,668,227 B2
(45) Date of Patent: Jun. 6, 2023

(54) STANDBY GENERATOR AIR FLOW MANAGEMENT SYSTEM

(71) Applicant: Champion Power Equipment, Inc., Santa Fe Springs, CA (US)

(72) Inventors: Mark J. Sarder, Waukesha, WI (US); Russell J. Dopke, Elkhart Lake, WI (US); Hiroaki Sato, Brookfield, WI (US); Leigh A. Jenison, Hartland, WI (US)

(73) Assignee: Champion Power Equipment, Inc., Santa Fe Springs, CA (US)

( * ) Notice: Subject to any disclaimer, the term of this patent is extended or adjusted under 35 U.S.C. 154(b) by 0 days.

(21) Appl. No.: 17/653,894

(22) Filed: Mar. 8, 2022

(65) Prior Publication Data

US 2022/0186652 A1 Jun. 16, 2022

Related U.S. Application Data

(63) Continuation of application No. 16/396,973, filed on Apr. 29, 2019, now Pat. No. 11,300,034.

(60) Provisional application No. 62/672,797, filed on May 17, 2018.

(51) Int. Cl.

| | |
|---|---|
| ***F01P 1/06*** | (2006.01) |
| ***F01P 5/04*** | (2006.01) |
| *F01P 5/02* | (2006.01) |

(52) U.S. Cl.

CPC *F01P 1/06* (2013.01); *F01P 5/04* (2013.01); *F01P 2005/025* (2013.01)

(58) Field of Classification Search

CPC ..... F01P 1/06; F01P 5/04; F01P 2005/025

USPC ..... 123/41.31

See application file for complete search history.

(56) References Cited

U.S. PATENT DOCUMENTS

| | | | | |
|---|---|---|---|---|
| 1,987,456 A * | 1/1935 | Woodard | 454/91 | |
| 4,702,201 A * | 10/1987 | Odo | F02B 63/04 | 290/1 A |
| 4,835,405 A * | 5/1989 | Clancey | F02B 63/04 | 290/1 A |
| 5,433,175 A * | 7/1995 | Hughes | F02B 77/13 | 181/204 |
| 5,694,889 A * | 12/1997 | Ball | F02B 75/005 | 123/41.7 |
| 5,778,832 A * | 7/1998 | King | F01P 3/18 | 165/DIG. 310 |

(Continued)

*Primary Examiner* — Logan M Kraft
*Assistant Examiner* — Anthony Donald Taylor, Jr.
(74) *Attorney, Agent, or Firm* — Ziolkowski Patent Solutions Group, SC

(57) ABSTRACT

A standby generator includes a standby generator enclosure having a partition wall separating a first end from an opposite second end of the enclosure, one or more airflow openings, and a first air duct and a second air duct each coupled to at least one of the one or more airflow openings. An engine mounts in the enclosure toward the first end from the partition wall, and an alternator driven by the engine mounts in the enclosure toward the second end from the partition wall. The engine includes an engine cooling fan that faces the first end to drive engine cooling air received from the first air duct toward the first end, and the alternator includes an alternator cooling fan that faces the second end to drive alternator cooling air received from the second air duct toward the second end.

21 Claims, 5 Drawing Sheets

(56) References Cited

U.S. PATENT DOCUMENTS 5,890,460 A * 4/1999 Ball ..... F02B 75/007 123/41.63
5,899,174 A * 5/1999 Anderson ..... F02B 77/13 290/1 A
5,977,644 A * 11/1999 Smith ..... F02B 63/04 290/1 R
6,376,944 B1 * 4/2002 Grizzle, Jr. ..... F02B 75/16 310/52
6,431,126 B2 * 8/2002 Saito ..... F02B 75/16 123/41.7
6,630,756 B2 * 10/2003 Kern ..... F02B 63/04 310/58
6,784,574 B2 * 8/2004 Turner ..... F02B 63/04 310/58
7,314,397 B2 * 1/2008 Sodemann ..... F01N 13/10 440/89 R
7,537,070 B2 * 5/2009 Maslov ..... B60L 50/62 180/65.25
7,557,458 B2 * 7/2009 Yamamoto ..... H02K 7/1815 219/133
7,642,665 B2 * 1/2010 Konop ..... F02B 63/047 290/22
2002/0000342 A1 * 1/2002 Yamada ..... E02F 9/0866 181/204
2002/0149203 A1 * 10/2002 Suzuki ..... F02B 75/16 290/1 A
2003/0042237 A1 * 3/2003 Brofft ..... F02B 63/06 219/133
2004/0004356 A1 * 1/2004 Akimoto ..... F02B 63/04 290/1 B
2011/0272952 A1 * 11/2011 Richardson ..... F02B 63/04 290/1 A
2013/0187392 A1 * 7/2013 Janscha ..... H02K 7/1815 290/1 A
2014/0209045 A1 * 7/2014 Hibi ..... F02B 63/04 123/2
2016/0233739 A1 * 8/2016 Jenison ..... H02K 7/1815
2016/0294255 A1 * 10/2016 Schmit ..... F02B 63/04
2016/0319728 A1 * 11/2016 Jenison ..... F01N 13/002

* cited by examiner

STANDBY GENERATOR AIR FLOW MANAGEMENT SYSTEM

CROSS-REFERENCE TO RELATED APPLICATION

The present application is a continuation of and claims priority to U.S. patent application Ser. No. 16/396,973, filed Apr. 29, 2019, which is a non-provisional of, and claims priority to, U.S. Provisional Patent Application Ser. No. 62/672,797, filed May 17, 2018, the disclosures of which are incorporated herein by reference in their entirety.

BACKGROUND OF THE INVENTION

Embodiments of the invention relate generally to standby generators, and more particularly to a generator having an enclosure with bi-directional flow of cooling air through the enclosure.

Standby generators provide a convenient source of backup electrical power for use when outages occur in the electrical grid. Standby generators typically use an internal combustion engine to drive an alternator that produces electricity for distribution to a home or building. The internal combustion engine can operate on a source of fuel stored in a tank with the generator or from a supply line connected to a public utility. For instance, a standby generator could be connected to a propane tank or a natural gas supply line. Standby generators are often connected to an automatic transfer switch which can automatically start the generator upon sensing an outage in the electrical grid.

Standby generators typically house the engine and the alternator in an enclosure. The standby generator enclosure protects the generator from weather and prevents unwanted intrusion from people and animals. Unfortunately, many generator enclosures are poorly ventilated. Standby generator enclosures may have airflow openings to provide air to the engine and vent exhaust fumes generated therein, but the airflow openings may not be located along optimal flow paths of airflow generators within the enclosure. For instance, the generator may contain an air-cooled engine having an engine fan, but the arrangement of the alternator driven by the engine may impede airflow from the engine fan out of the enclosure. In addition, noise levels from standby generators are often most critical in front of the generator. Unfortunately, many generators have airflow openings in a front portion of the enclosure which can increase noise escaping through the front of the enclosure.

In addition, standby generators can have single direction airflow within the enclosure, i.e. generally from right to left or vice versa or from bottom to top or vice versa. For instance, many standby generators have the alternator positioned on an opposite side of the engine from the engine cooling fan. In this arrangement, the engine fan drives air heated by the engine in the direction of the alternator causing the alternator to operate at increased and less efficient temperatures. Further, the alternator may have an alternator fan that draws alternator cooling air from a combined intake path with the engine cooling air. Unfortunately, the engine fan can overpower the alternator fan causing reduced airflow to the alternator. Further, engine intake air can be difficult to calibrate in a combined intake arrangement.

Therefore, it would be desirable to have a standby generator with bi-directional airflow for cooling an engine and an alternator in a standby generator enclosure. It would be further desirable to provide a standby generator enclosure having airflow openings positioned to optimize venting and reduce noise in front of the generator.

BRIEF DESCRIPTION OF THE INVENTION

Embodiments of the invention are directed to a standby generator having an engine and an alternator cooled with air flowing in opposite directions for improved airflow management.

In accordance with one aspect of the invention, a standby generator includes a standby generator enclosure having a first end and a second end opposite the first end. The standby generator enclosure may include a partition wall separating the first end from the second end, one or more airflow openings, and a first air duct and a second air duct each coupled to at least one of the one or more airflow openings. An engine mounts in the enclosure toward the first end from the partition wall with the engine comprising an engine cooling fan fluidly coupled to the first air duct. An alternator driven by the engine mounts in the enclosure toward the second end from the partition wall with the alternator comprising an alternator cooling fan fluidly coupled to the second air duct. The engine cooling fan preferably faces the first end to drive engine cooling air received from the first air duct toward the first end, and the alternator cooling fan preferably faces the second end to drive alternator cooling air received from the second air duct toward the second end.

In accordance with another aspect of the invention, a multi-chamber standby generator includes a multi-chamber generator enclosure having a partition wall that may form at least a first chamber and a second chamber, the first chamber and the second chamber each comprising an air inlet and an air outlet. A first air duct couples to the air inlet of the first chamber and a second air duct couples to the air inlet of the second chamber. An air-cooled engine is located in the first chamber with the air-cooled engine comprising an engine cooling fan coupled to the air inlet of the first chamber by the first air duct, and an alternator driven by the air-cooled engine is located in the second chamber with the alternator comprising an alternator cooling fan coupled to the air inlet of the second chamber by the second air duct.

In accordance with yet another aspect of the invention, a generator includes a generator enclosure having a first end and a second end opposite the first end, the generator enclosure including a plurality of airflow openings with an airflow opening in the first end and an airflow opening in the second end. An engine and an alternator driven by the engine mount in the enclosure, the engine and alternator mount in a horizontal crankshaft orientation with the engine positioned toward the first end of the enclosure and the alternator positioned toward the second end of the enclosure. An engine cooling fan may be driven by the engine and positioned on a side of the engine opposite from the first end of the enclosure, and an alternator cooling fan may be coupled to the alternator and driven by the engine with the alternator cooling fan positioned on a side of the alternator opposite from the first end of the enclosure. An exhaust side of the engine cooling fan preferably faces the first end of the enclosure and an exhaust side of the alternator cooling fan preferably faces the second end of the enclosure.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION OF THE PREFERRED EMBODIMENT

The operating environment of the invention is described with respect to a standby generator. However, those skilled in the art will appreciate that the invention is equally applicable for use with portable or other electrical generators. While the invention will be described with respect to a standby generator having a multi-chamber generator enclosure, embodiments of the invention are equally applicable for use with single-chamber or other types of generator enclosures.

Figure 1:
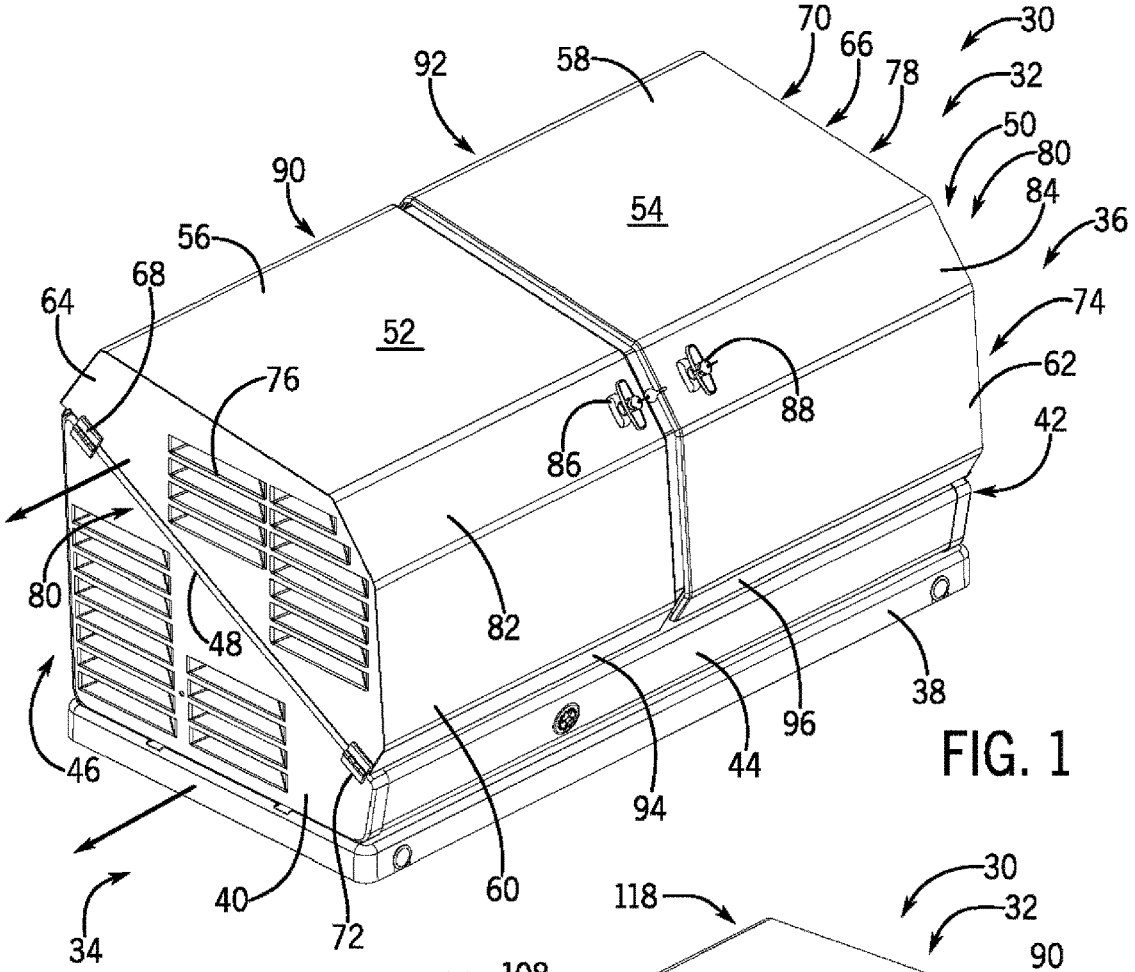
FIG. 1 is a perspective view from the left upper side of an electrical generator, according to an embodiment of the invention.

Referring to FIG. 1, a standby generator 30 is shown, in accordance with an embodiment of the invention. The standby generator 30 produces electrical energy and may deliver the electrical energy to a distribution panel of a home, office, shop, business or any other building requiring electricity. The standby generator 30 may include an internal combustion engine, an alternator driven by the internal combustion engine, and other associated components. The internal combustion engine operates on a fuel source that may include gasoline, diesel, liquefied petroleum gas (LPG), propane, butane, natural gas, or any other fuel source suitable for operating the engine. For instance, the internal combustion engine may comprise a single fuel engine configured to operate on one of the fuels. Alternatively, the engine may comprise a dual fuel or multi-fuel engine configured to switch operation between two or more of the fuel sources. For example, the engine may comprise a dual fuel engine configured to switch operation between LPG and gasoline, or LPG and diesel. The alternator and engine may form an engine-generator set used to produce electricity for distribution from the standby generator 30.

The standby generator 30 may include a standby generator enclosure or housing 32 to house the engine-generator set and other associated components. In the embodiment of FIG. 1, the engine-generator set is positioned in a horizontal crankshaft arrangement with the engine located toward a first end 34 of the enclosure 32 and the alternator located toward a second end 36 of the enclosure 32. The standby generator enclosure 32 may include a base 38 to support the engine-generator set. The enclosure 32 may also have a first sidewall 40 and a second sidewall 42 each extending generally vertically from opposite ends of the base 38 at the first end 34 and the second end 36 of the enclosure 32, respectively. The enclosure 32 may also include a front wall 44 and a back wall 46 extending generally vertically from the base 38 between the first sidewall 40 and the second sidewall 42, with the front wall 44 and the back wall 46 defining a front and a back sidewall of the standby generator 30. The front wall 44 and the back wall 46 may be angled slightly from vertical such that each has a bottom portion positioned slightly inward from a corresponding top portion. The first sidewall 40 and the second sidewall 42 may each have a respective top edge 48, 50 that generally slopes diagonally from a taller back wall 46 to a shorter front wall 44.

The enclosure 32 may also include one or more hoods to cover the standby generator 30. The embodiment shown in FIG. 1 has a first hood 52 and a second hood 54, also referred to as doors, coupled to a respective first sidewall 40 and second sidewall 42. The first hood 52 and the second hood 54 may each have a top panel 56, 58, a front panel 60, 62, and a side panel 64, 66 with the side panels generally perpendicular to the respective top and front panels. The side panels 64, 66 of each hood 52, 54 may each be coupled to a respective one of the first sidewall 40 and the second sidewall 42 of the enclosure 32 using a first hinge 68, 70 and a second hinge 72, 74, with the first hinges near the back of the enclosure 32 and the second hinges near the front of the enclosure 32. The first hood 52 may be hinged to the enclosure 32 to rotate over a top of the first sidewall 40 and the second hood 54 may be hinged to the enclosure 32 to rotate over a top of the second sidewall 42. The first hood 52 and the second hood 54 may rotate about an upper or top edge 48, 50 of each respective sidewall 40, 42 beyond the first end 34 and the second end 36 of the enclosure 32 in a "gull wing" configuration for ease of access and serviceability to the generator 30 through the front of the enclosure. The "gull wing" configuration may allow the first hood 52 and the second hood 54 to open without contacting a home, office, shop, business, or any other building requiring electricity located behind the standby generator 30.

The first hood 52 and the second hood 54 may open outwards beyond the respective first sidewall 40 and second sidewall 42 to expose a top and front entrance into the enclosure 32. The front wall 44 may be relatively short compared to the overall height of the enclosure 32 in part to allow for improved front access into the enclosure 32 when the hoods 52, 54 are open. The back wall 46 may be relatively tall compared to the front wall 44 with the first sidewall 40 and the second sidewall 42 having a forward sloping top edge 48, 50 from the back wall 46 to the front wall 44. The first hood 52 and the second hood 54 can then open upward and slightly forward as they rotate along the forward sloping top edge 48, 50 of each respective sidewall 40, 42. In other embodiments, the first hood 52 and the second hood 54 may rotate about a horizontal or vertical edge of a respective first sidewall 40 and second sidewall 42 between opened and closed positions.

As shown in FIG. 1, the side panels 64, 66 may include vents 76, 78 with louvers, and vents may be formed in the first sidewall 40 and the second sidewall 42. The vents 76, 78 may provide one or more airflow openings 80 in the standby generator enclosure 32. The top panels 56, 58 are preferably sloped downward toward the front of the enclosure 32 and the front panels 60, 62 may slope forward toward the base 38 of the enclosure 32 to enhance water runoff. Each hood 52, 54 may also have a front transition panel 82, 84 between the respective top panel 56, 58 and the front panel 60, 62. The front transition panels 82, 84 further encourage water runoff and add to an aesthetically pleasing design. A handle 86, 88 may be attached to the front transition panel 82, 84 of each hood 52, 54 for opening the hoods and exposing internal components of the standby generator 30. The front transition panels 82, 84 are designed so the handles 86, 88 enhance accessibility by directionally facing a person standing in front of the enclosure 32 when the hoods 52, 54 are closed. Each hood 52, 54 may also have a rear transition panel 90, 92 that slopes downward from the respective top panel 56, 58 toward the back wall 46 when the hoods are closed. Each hood 52, 54 may also have a lower transition panel 94, 96 that slopes inward from the respective front panel 60, 62 toward the front wall 44 when the hoods are closed. The rear transition panels 90, 92 and the lower transition panels 94, 96 further encourage water runoff and add to an aesthetically pleasing design.

Figure 2:
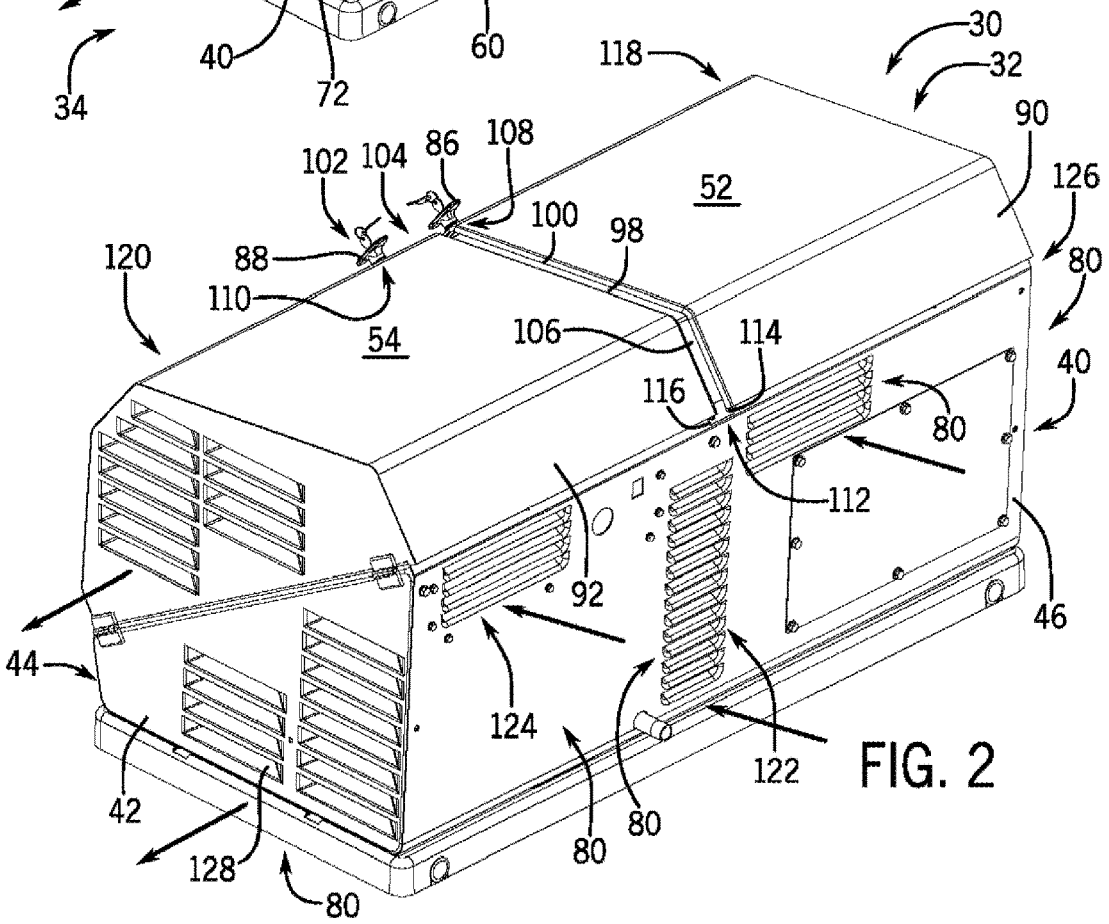
FIG. 2 is a rear perspective view from the right upper side of the electrical generator of FIG. 1, according to an embodiment of the invention.

Referring now to FIG. 2, a rear view of standby generator 30 is provided in accordance with an embodiment of the invention. FIG. 2 shows a support arm 98 extending across a center of the enclosure 32 to support the first hood 52 and the second hood 54 in the closed position. The support arm 98 extends from the back wall 46 over an interior of the enclosure 32 to the front wall 44. The support arm 98 may have a geometry that matches the first hood 52 and the second hood 54 to ensure the hoods close tightly against the support arm. Accordingly, the support arm 98 may have a top panel 100, a front panel 102, a front transition panel 104, and a rear transition panel 106 to match the first hood 52 and the second hood 54. The support arm 98 may also receive a latch 108, 110 from each handle 86, 88 to hold the first hood 52 and the second hood 54 closed.

The support arm 98 preferably has a channel or gutter 112 extending the length of the support arm to channel water off the front and back of the enclosure 32. The gutter 112 may be formed by raised outer edges that include a first rain seal 114 and a second rain seal 116 on opposite sides of the support arm 98. The first rain seal 114 and the second rain seal 116 each support and seal a respective hood 52, 54 in the closed position. The first rain seal 114 and the second rain seal 116 may also extend across portions of the back wall 46, front wall 44, and respective first and second sidewalls 40, 42 to seal around each perimeter entrance covered by the hoods 52, 54. The rain seals 114, 116 prevent rain from entering the enclosure 32 and may make the enclosure rain tight. Although some water may enter the enclosure 32 without negatively affecting the generator 30, it is desirable to prevent water from entering the electrical areas within the enclosure 32. The rain seals 114, 116 may make the electrical areas within the enclosure 32 rain tight.

According to an exemplary embodiment of the invention, the standby generator 30 has an enclosure 32 with multiple chambers to separate components and one or more airflow inlets in a backwall of the generator enclosure 32, so as to manage heat transfer in the enclosure 32. The multi-chamber generator enclosure 32 may include at least a first chamber 118 and a second chamber 120 each comprising an air inlet 122, 124 and an air outlet 126, 128. The air inlet 122 of the first chamber 118 and the air inlet 124 of the second chamber 120 are shown as airflow openings 80 in the back wall 46 of the multi-chamber generator enclosure 32. The air outlet 126 of the first chamber 118 and the air outlet 128 of the second chamber 120 are shown as airflow openings 80 in opposite end walls 40, 42 of the multi-chamber generator enclosure 32 between the front wall 44 and the back wall 46. Rear transition panels 90, 92, 106 may extend over the air inlets 122, 124 to direct rain off the enclosure away from the inlets.

Figure 3:
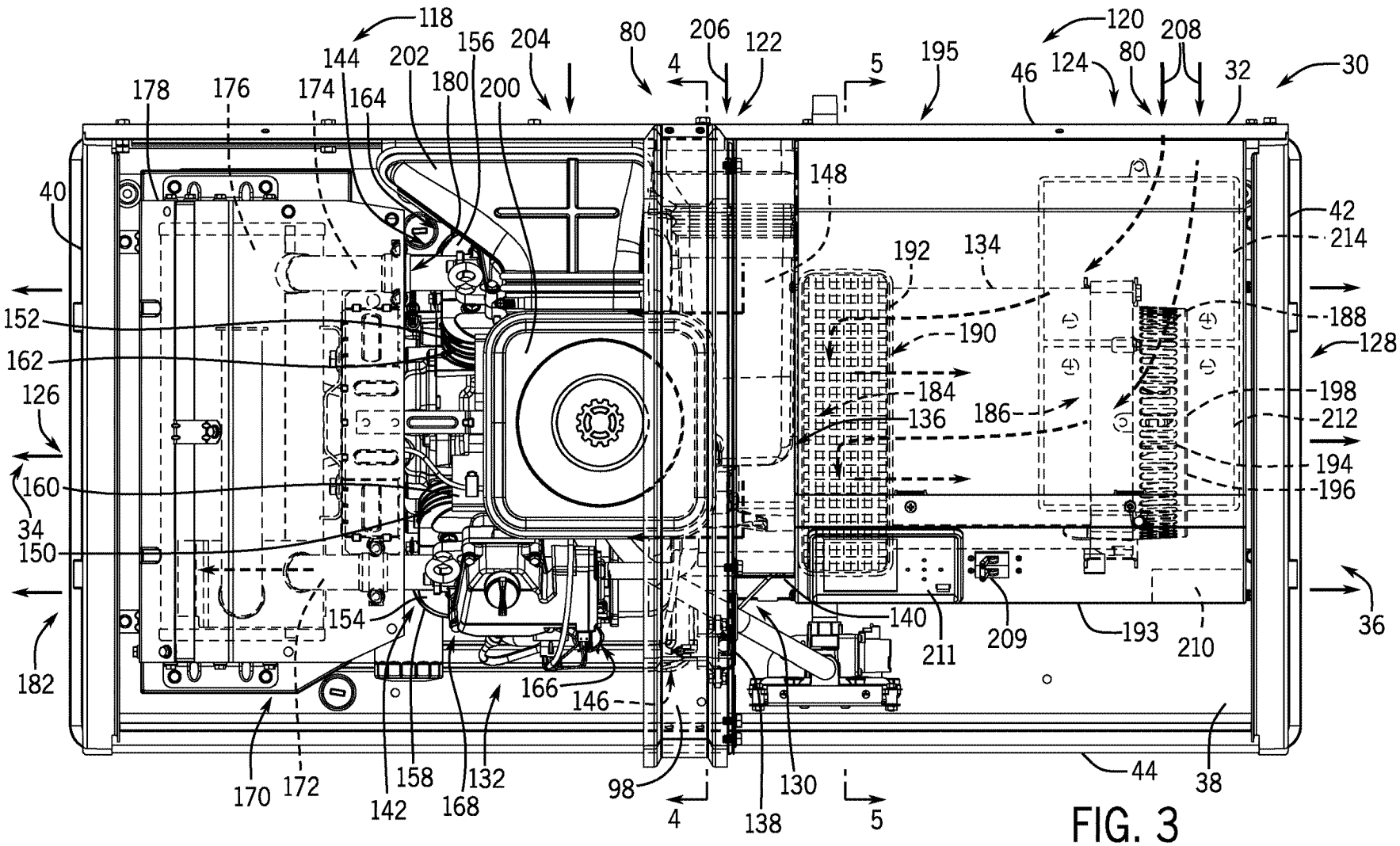
FIG. 3 is a top view of the generator of FIG. 1 with left and right hoods hidden to expose the electrical generator components within, according to an embodiment of the invention.

Referring now to FIG. 3, a top view of the standby generator 30 looking into the enclosure 32 is shown, according to an embodiment of the invention. The standby generator 30 comprises a partition wall 130 separating the enclosure 32 into at least the two chambers 118, 120, with the engine 132 and the alternator 134 preferably located or mounted in separate chambers 118, 120. The partition wall 130 may extend from the support arm 98 to the base 38 of the enclosure 32, and also from the front wall 44 to the back wall 46 of the enclosure 32. The partition wall 130 may have an opening 136 through which the engine 132 mounted to the base 38 in the first chamber 118 can couple to drive the alternator 134 mounted to the base 38 in the second chamber 120. The partition wall 130 may comprise a main segment 138 aligned with the support arm 98 and an offset segment 140 spaced apart from the main segment 138 in a direction opposite the engine 132. The offset segment 140 provides clearance for air to flow between the engine 132 and the partition wall 130 from an airflow opening 122 in the back wall 46.

The engine 132 may comprise a v-twin engine having two cylinders 142, 144. FIG. 3 shows the engine 132 mounted in a horizontal crankshaft orientation with the crankshaft driving the alternator 134 through the opening 136 in the partition wall 130. The engine 132 may comprise an air-cooled engine having an engine cooling fan 146 (FIG. 4) at a front portion of the engine facing the partition wall 130. The engine cooling fan 146 may draw a stream of air along the offset segment 140 of the partition wall 130 into the enclosure 32 through the airflow opening 122 in the back wall 46. An inlet air duct 148 (i.e., engine air duct) provided as part of an alternator adaptor, may couple the engine 132 to one or more airflow openings 80 in fluid communication with the engine cooling fan 146.

The engine cooling fan 146 preferably drives the stream of air over cylinders 142, 144 of the engine 132 in a direction toward the first end 34 of the enclosure 32. The engine 132 comprises one or more cylinders 142, 144 and corresponding cylinder heads 150, 152 each comprising a plurality of cooling fins 154, 156. Each cylinder 142, 144 may comprise one or more air guides 158, 160 mounted over the plurality of cooling fins 154, 156. The cylinders 142, 144 may have inner surfaces 162 generally facing each other and outer surfaces 164 opposite the inner surfaces 162 with an inner air guide 160 mounted over each inner surface 162 and an outer air guide 158 mounted over each outer surface 164. The outer and inner air guide 158, 160 may each have a front portion 166 extending to a front side of the respective cylinders 142, 144 (engine fan side) and a back portion 168 extending to the back side of the respective cylinders 142, 144. The outer and inner air guides 158, 160 direct cooling air from a front side of the cylinders 142, 144 through the cooling fins 154, 156 to the back side of the cylinders 142, 144.

The engine 132 may also include an exhaust system 170 operatively coupled to the engine 132. The exhaust system 170 may comprise one or more engine exhaust pipes 172, 174 operatively coupled to the engine 132 extending therefrom in a direction downstream from the engine cooling fan 146. The exhaust system 170 may comprise a muffler 176 coupled to at least one of the one or more engine exhaust pipes 172, 174 and may be positioned within a muffler box 178.

The muffler box 178 can surround the muffler 176 managing heat transfer from the muffler 176 within the enclosure 32. The muffler box 178 may extend approximately from the engine 132 to the first sidewall 40 and approximately from the front wall 44 to the back wall 46 of the enclosure 32. The muffler box 178 may mount to the base 38 of the enclosure 32 and extend to a height above cylinders 142, 144 of the engine 132. The exhaust pipes 172, 174 may extend through an opening 180 into the muffler box 178, with the opening 180 positioned in an airflow path downstream from the engine cooling fan 146.

The engine cooling fan 146 can drive cooling air in a direction of the exhaust system 170 through the plurality of cooling fins 154, 156 in each of the one or more cylinders 142, 144 and corresponding cylinder heads 150, 152. The outer air guides 158 and the inner air guides 160 mount to the cylinders 142, 144 directing cooling air from the engine cooling fan 146 through the plurality of cooling fins 154, 156. Upon cooling the cylinders 142, 144, the cooling air can flow over the exhaust system 170. The muffler box 178 receives cooling air expelled from the engine 132 through the opening 180 and cools the muffler 176 by directing the cooling air over the muffler 176. The muffler box 178 may also direct the cooling air out of the enclosure 32 through vents 182 in the first sidewall 40.

FIG. 3 also shows an alternator 134 driven by the engine 132 mounted in the enclosure 32 to produce electrical power for distribution from the standby generator 30. The alternator 134 may have a first end 184 coupled to the engine 132 and a second end 186 having an alternator cooling fan 188 on a side of the alternator 134 opposite the engine 132. The alternator cooling fan 188 can draw a stream of air into the alternator 134 through an inlet 190 located proximate the first end 184. The inlet 190 may be located in a side of the alternator 134 between the first end 184 and the second end 186. In one embodiment of the invention, an alternator inlet air duct 192 formed in a side of the alternator may couple the alternator 134 to a generator control box 193 to provide cooling air flowing through the control box to the alternator cooling fan 188. The control box 193 is shown coupled to an airflow opening 124 in the back wall 46 in fluid communication with the alternator cooling fan 188. The inlet air duct 192 and the control box 193 may together form an air passageway or air duct 195 extending from the airflow opening 124 to the alternator 134. Accordingly, cooling air can enter the enclosure 32 through the airflow opening 124 and pass through the air duct 195 to the alternator 134. The alternator cooling fan 188 draws air through the alternator 134 in a direction opposite the engine 132.

The alternator cooling fan 188 can draw a stream of air axially through the alternator 134 to vents 194 in a fan guard 196 covering the fan. The vents 194 may comprise slots around a circumference of the fan guard 196. The fan guard 196 may include a solid plate 198 covering the second end 186 of the alternator 134 preventing air drawn into the alternator cooling fan 188 through the second end 186. In an alternative embodiment of the invention, the alternator cooling fan 188 could drive air axially through the alternator 134 from vents in the second end 186 to a vent proximate the first end 184.

Accordingly, the standby generator 30 may include a first air duct 148 and a second air duct 195 each coupled to at least one of the airflow openings 80, with the first air duct 148 coupled to the engine 132 to provide a cooling air flow path from the respective airflow opening 80 to the engine cooling fan 146, and with the second air duct 195 coupled to the alternator 134 to provide a separate cooling air flow path from the respective airflow opening 80 to the alternator cooling fan 188. Each of the airflow openings 80 coupled to the first air duct 148 and the second air duct 195 may be formed in a same enclosure wall 40, 42, 46, 44 of the generator enclosure 32. FIG. 3 shows the first air duct 148 and the second air duct 195 coupled to one or more airflow openings 80 in the back wall 46 (i.e., openings/inlets 122, 124), which can lower sound measurements of the standby generator 30 since sound standards often require measurement from a front center of a standby generator. While the airflow opening 124 is shown distinct from the airflow opening 122, the airflow opening 124 could be formed integrally with the airflow opening 122 to provide airflow from a single opening into the enclosure 32 to the first air duct 148 and the second air duct 195. FIG. 3 also shows an air filter 200 coupled to receive engine charge air from a third air duct 202 extending to an opening 204 in the back wall 46 of the enclosure 32. The three air ducts 148, 195, 202 provide a tri-flow arrangement within the enclosure 32.

The engine cooling fan 146 may be driven by the engine 132 to force a first stream of cooling air 206 from the first air duct 148 through the engine 132 in a direction opposite the alternator 134. The muffler box 178 surrounds the muffler 176 and has an opening 180 in a flow path of the first stream of cooling air 206 to direct the first stream of cooling air 206 over the muffler 176. The engine cooling fan 146 may face the first end 34 of the enclosure 32 upstream from an airflow opening 126 in the first end 34. The alternator cooling fan 188 may be coupled to the alternator 134 and driven by the engine 132 or the alternator to force a second stream of cooling air 208 from the second air duct 195 through the alternator 134 in a direction opposite the engine 132. The alternator cooling fan 188 may face the second end 36 of the enclosure 32 upstream from an airflow opening 128 in the second end 36.

As referred to previously, the standby generator 30 may include a control box 193 which may house generator controls 209, control system electronics 211, and/or other generator components. The control box 193 is shown coupled to the back wall 46 extending forward above the alternator 134 and is preferably coupled to both the air flow opening 124 in the back wall 46 and the alternator inlet air duct 192. The alternator cooling fan 188 may draw the second stream of cooling air 208 through the control box 193 to cool generator control components prior to cooling the alternator 134. The standby generator 30 may also include a battery charger 210 mounted in the control box 193 to charge a first battery 212 and a second battery 214 which may be housed in the control box. The batteries 212, 214 can be used to crank the engine 132 for startup in the event of a power outage in the utility grid. Airflow through the control box 193 can cool the batteries 212, 214 and the control system electronics 211 to operate at a lower temperature.

Figure 4:
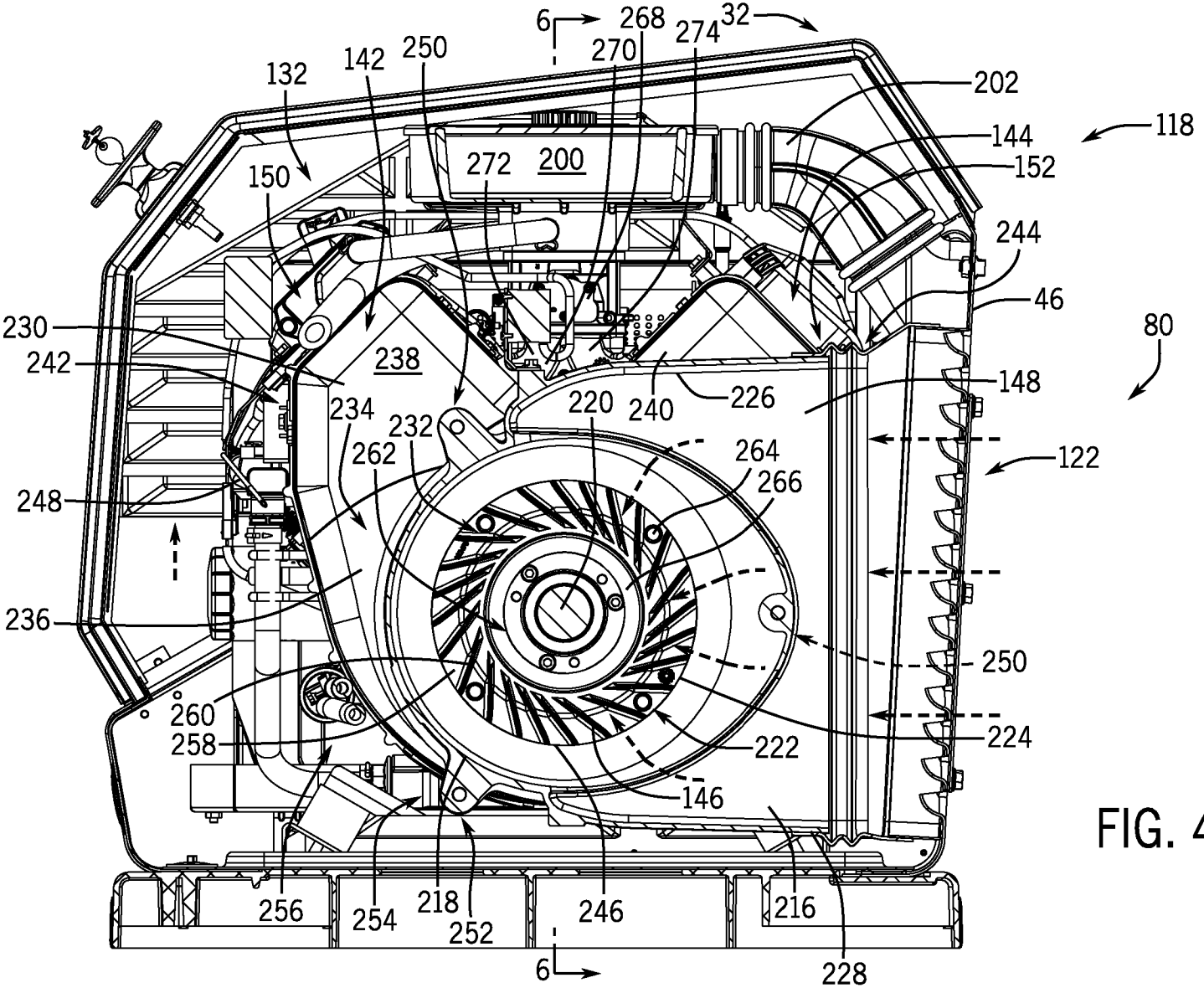
FIG. 4 is a cross-sectional view taken along line 4-4 of FIG. 3 showing a portion of an alternator adaptor coupled to an engine of the generator under a closed left hood, according to an embodiment of the invention.

Referring now to FIG. 4, a cross section of the generator through an alternator adaptor 216 that couples the alternator 134 (FIG. 3) to the engine 132 is shown, in accordance with an embodiment of the invention. The alternator adaptor 216 may comprise an adaptor cylinder 218 that couples the alternator 134 (FIG. 3) to the engine 132 with the crankshaft 220 extending through an airflow opening 222 in an engine mounting flange 224 at a first end of the adaptor cylinder. The alternator adaptor 216 may include inlet air duct 148 extending from a side of the alternator adaptor 216. The inlet air duct 148 may be in fluid communication with the airflow opening 222 to provide airflow to the engine cooling fan 146.

The inlet air duct 148 can have a generally rectangular cross-section with a width approximately equal to the length of the adaptor cylinder 218, and a height slightly larger than a diameter of the adaptor cylinder 218. The inlet air duct 148 can extend across a center of the adaptor cylinder 218 with a top surface 226 and a bottom surface 228 curving into the adaptor cylinder 218. The inlet air duct 148 preferably extends to airflow opening 122 in the back wall 46 of the enclosure 32. The engine cooling fan 146 may be positioned to draw cooling air through the air duct 148 coupling the air-cooled engine 132 to the air inlet 122 of the first chamber 118.

FIG. 4 also shows a fan cover 230 mounted over the engine cooling fan 146 between the engine 132 and the alternator adaptor 216, the fan cover 230 preferably having an airflow opening 232 surrounding the crankshaft 220 of the engine. The fan cover 230 may be mounted over a front side 234 of the engine 132. The fan cover 230 can include the main section 236 covering the engine cooling fan 146, and a first arm 238 and a second arm 240 each extending from the main section to cover a front side 234 of a respective cylinder 142, 144. For instance, the fan cover 230 may be mounted over the engine cooling fan 146 and over sides of two cylinder blocks 242, 244 and sides of two cylinder heads 150, 152 of the cylinders 142, 144. The engine cooling fan 146 preferably drives cooling air from the main section 236 through the first arm 238 and the second arm 240 to the cylinders 142, 144.

The fan cover 230 may include an alternator adaptor mounting surface 246 that mates to the alternator adaptor 216. Fasteners can extend through openings in the alternator adaptor mounting surface 246 to mount the alternator adaptor 216 to the crankcase 248. The fan cover 230 is shown having three openings 250 for the fasteners with one opening located in a tab 252 extending outward from the main section 236 of the fan cover 230. The crankcase 248 may have mounting locations 254 each comprising a boss extending forward from the engine 132 and each having a threaded opening to receive a respective fastener from the alternator adaptor 216. The fan cover 230 may include side portions 256 extending around the main section 236 and both arms 238, 240. The side portions 256 extend generally perpendicular to the main section 236 and the arms 238, 240, with rounded corners connecting the side portions 256 to the main section 236 and the arms 238, 240. The side portions 256 couple to the crankcase 248 and direct airflow to the cylinders 142, 144.

The engine cooling fan 146 may be operatively coupled to the crankshaft 220 on a side of the engine 132 facing the alternator adaptor 216. The engine cooling fan 146 may include an annular disc 258 with a plurality of fan blades 260 extending from one side of the annular disc. The fan blades 260 are shown extending from a center opening 262 to a perimeter of the annular disc 258. The annular disc 258 may include openings for fasteners 264 to mount the engine cooling fan 146 to a fan base 266, which may comprise a plurality of bolts. The fan base 266 mounts to the crankshaft 220. The crankshaft 220 can be inserted through the center opening 262 in the annular disc 258 such that the fasteners 264 can secure the engine cooling fan 146 to the fan base 266. The engine cooling fan 146 preferably draws a stream of cooling air through the alternator adaptor 216 into the airflow opening 232 in a main section 236 of the fan cover 230 and drives the air through two arms 238, 240 of the cover to each respective cylinder 142, 144.

According to one embodiment of the invention, the combustion intake air duct 202 extends from at least one of the plurality of airflow openings 80 to either a carburetor or a fuel and air mixer 268 of the engine 132. FIG. 4 shows an embodiment of the engine 132 having the fuel and air mixer 268 coupled between the cylinders 142, 144 on a top portion of the engine 132. The fuel and air mixer 268 may couple to the air filter 200 that receives air from the air duct 202. The fuel and air mixer 268 combines air with gaseous fuel and supplies the combination to the cylinders 142, 144. The fuel and air mixer 268 couples to an intake manifold 270 having an intake pipe 272, 274 for each cylinder 142, 144. The intake pipes 272, 274 cross a front side 234 of the engine 132 to intake ports of respective cylinder heads 150, 152. The fuel and air mixer 268 may be used instead of a carburetor for engines configured to operate on gaseous fuel, for instance LPG, propane, or natural gas.

Figure 5:
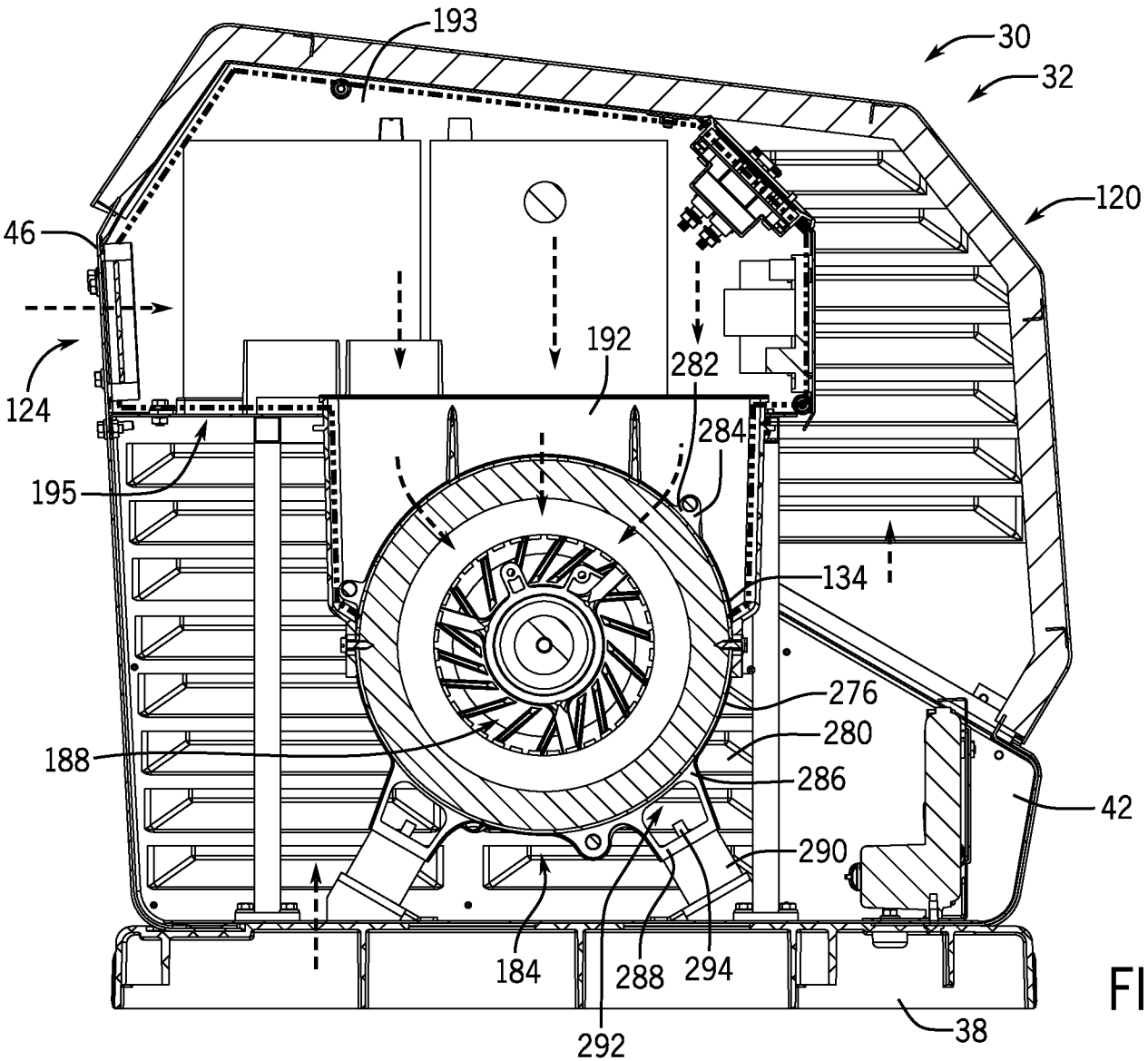
FIG. 5 is a cross-sectional view taken along line 5-5 of FIG. 3 showing a portion of an air duct coupled to an alternator of the generator under a closed right hood, according to an embodiment of the invention.

Referring now to FIG. 5, a cross section of the standby generator 30 through alternator air duct 192 is shown, in accordance with an embodiment of the invention. The alternator 134 may be driven by the air-cooled engine 132 (FIG. 4) and mounted in the second chamber 120, with the alternator 134 preferably comprising alternator cooling fan 188 positioned to draw cooling air through the second air duct 195 coupling the alternator 134 to the air inlet 124 of the second chamber 120. The alternator 134 may comprise a cylindrical outer casing 276, with the alternator inlet air duct 192 coupled to a side of the cylindrical outer casing 276 proximate the first end 184 of the alternator. The alternator inlet air duct 192 is shown coupled to the control box 193 to form the second air duct 195. In an alternative embodiment, the alternator inlet air duct 192 extends to airflow opening 124 in the back wall 46 and includes a boot sealing the air duct 192 to the airflow opening 124. The alternator cooling fan 188 draws cooling air axially through the alternator 134 from the inlet air duct 192 and can drive the cooling air out of the enclosure 32 through vents 280 in the second sidewall 42.

The alternator 134 may include a rotor bearing carrier 282 having mounting projections 284 around an outer periphery to receive fasteners that couple the alternator to the alternator adaptor 216 (FIG. 4). The rotor bearing carrier 282 may also include a lower support 286 to mount the alternator 134 to the base 38 of the enclosure 32. The lower support 286 may include a bottom portion 288 that rests on a vibration isolator 290. The lower support 286 may also include a hollow portion 292 above the bottom portion 288 to access a fastener 294 extending through the bottom portion 288 and the vibration isolator 290.

Figure 6:
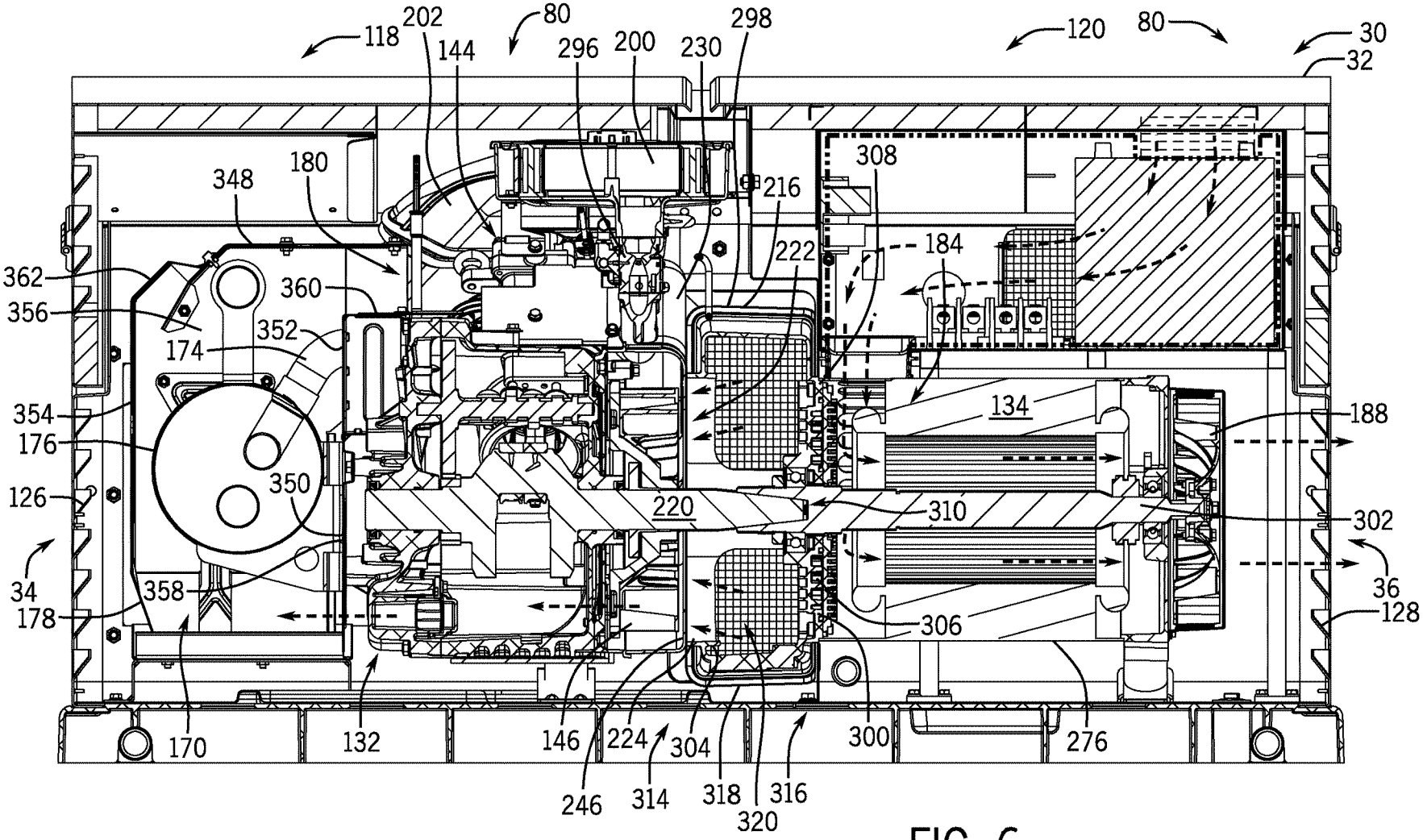
FIG. 6 is a cross-sectional view of the generator of FIG. 1 taken vertically along a crankshaft of a generator engine, according to an embodiment of the invention.

Referring now to FIG. 6, a cross-section of the standby generator 30 taken axially through crankshaft 220 is shown, according to an embodiment of the invention. In the embodiment of FIG. 6, a carburetor 296 is provided that mixes air with a liquid fuel, e.g. gasoline, and supplies the mixture to cylinders 142 (FIG. 4), 144 of the engine 132. The carburetor 296 can be coupled to receive air from air filter 200 with combustion intake air duct 202 coupling to one or more airflow openings 80 in generator enclosure 32 and to either the fuel and air mixer 268 of FIG. 4 or the carburetor 296 of FIG. 6 operatively coupled to the engine 132.

As shown in FIG. 6, alternator adaptor 216 has a main body comprising a cylinder 298, with the engine mounting flange 224 at a first end of the cylinder 298 and connected to the engine 132, and with an alternator mounting flange 300 at a second end of the cylinder 298 and connected to the alternator 134. The alternator adaptor 216 may accommodate shafts extending therethrough from the engine 132 to the alternator 134. For instance, the crankshaft 220 may extend through the engine mounting flange 224 to drive an alternator shaft 302 extending through the alternator mounting flange 300.

The engine mounting flange 224 may comprise an outlet casement 304 extending from an interior of the main body 298 to mate against the alternator adaptor mounting surface 246 of the fan cover 230. The alternator mounting flange 300 may comprise a circular plate 306 with an indented ridge 308 around a perimeter edge to receive the cylindrical outer casing 276 of the alternator 134. The circular plate 306 can mount against the alternator 134, with the plate having an opening 310 for passage of the alternator shaft 302. The opening 310 may be small to prevent substantial airflow through the first end 184 of the alternator 134, thus preventing the alternator 134 and engine 132 from drawing air in opposite directions in the alternator adaptor 216.

A first end 314 of alternator adaptor 216 comprising airflow opening 222 to the engine cooling fan 146 is coupled to the engine 132 and a second end 316 of alternator adaptor 216 is coupled to the alternator 134. The first end 314 may be spaced apart from the second end 316 allowing airflow into the alternator adaptor 216. Accordingly, the engine cooling fan 146 may be coupled to the crankshaft 220 in a spaced relationship from the alternator 134 so as to create an airflow path to the engine cooling fan 146 that bypasses the alternator 134. The alternator adaptor 216 may provide a shroud 318 positioned around a portion of the crankshaft 220, the shroud 318 comprising an air inlet shown as a plurality of vents 320 between the first end 314 and the second end 316, and comprising an airflow opening 222 to the engine 132 in the first end 314.

As shown in FIG. 6 and as previously described, the engine cooling fan 146 may be mounted to an upstream side of the engine 132, between the engine 132 and the alternator 134. The engine cooling fan 146 preferably drives cooling air through the air-cooled engine 132 in a direction opposite the alternator 134. The exhaust system 170 extends from the engine 132 in a direction downstream from the engine cooling fan 146 and in a direction opposite the alternator 134. The muffler 176 of exhaust system 170 is at least partially enclosed in heat shield 178 (muffler box) that funnels cooling air expelled from the engine 132 over the muffler 176.

The muffler box 178 cools the muffler 176 with air received through the opening 180 into the muffler box. The muffler box 178 may include a plurality of heat shield panels 348, 350, 352, 354, 356. For instance, the muffler box 178 may include a top panel 348, a lower forward panel 350, an upper forward panel 352, a rearward panel 354, and two opposing side panels 356 between the forward and rearward panels 350, 352, 354. The lower forward panel 350 extends short of the top panel 348 creating the opening 180 into the muffler box 178 through which the exhaust pipes 172 (FIG. 3), 174 can extend. The upper forward panel 352 extends from the lower forward panel 350 into a region between the exhaust pipes 172 (FIG. 3), 174, blocking heat transfer from an upper portion of the muffler 176 to the engine 132. The lower forward panel 350 and the upper forward panel 352 provide a heat shield 358 mounted between the muffler 176 and the engine 132.

The upper forward panel 352 can allow cooling air expelled from the engine 132 to pass into the muffler box 178 since the upper forward panel 352 is preferably positioned between flow paths from the cylinders 142 (FIG. 4), 144. The muffler box 178 also has deflector panels 360 surrounding the opening 180 funneling air from the cylinders 142 (FIG. 4), 144 into the muffler box 178 and over the muffler 176. The muffler box 178 may also have a rearward sloping top panel 362 connected to the rearward panel 354. The rearward sloping top panel 362 may be spaced apart from the top panel 348 creating an exhaust opening in the muffler box 178.

In summary, the airflow opening 126 in first end 34 of the generator enclosure 32 downstream from the engine cooling fan 146 and the airflow opening 128 in opposing second end 36 of the enclosure 32 downstream from the alternator cooling fan 188 allow for a bidirectional cooling of generator 30. That is, the engine cooling fan 146 can drive the cooling air driven through the engine 132 and out through the air outlet 126 of the first chamber 118 and the alternator cooling fan 188 can drive the cooling air drawn through the alternator 134 and out through the air outlet 128 of the second chamber 120. The bidirectional airflow created by the engine cooling fan 146 and the alternator cooling fan 188 directing air through air outlets 126, 128 in opposing ends 34, 36 of the enclosure 32 can effectively double the area available for ventilation from the enclosure 32 compared to a single directional flow with fans facing only one end of the enclosure. The bidirectional airflow can reduce airflow required in a particular direction of the enclosure 32 leading to a smaller standby generator 30.

Beneficially, embodiments of the invention provide a multi-chamber standby generator having an engine and an alternator driven by the engine mounted in separate chambers. Each chamber may have an airflow inlet and an airflow outlet to the environment providing separate streams of cooling air to the engine and the alternator. An engine cooling fan can force a stream of cooling air through the engine in a direction opposite the alternator, and an alternator cooling fan can force a stream of cooling air through the alternator in a direction opposite the engine. Each chamber may include an airduct coupling an airflow inlet to the respective fans, and an airflow outlet at opposite ends of the generator.

Therefore, according to one embodiment of the invention, a standby generator includes a standby generator enclosure having a first end and a second end opposite the first end. The standby generator enclosure may include a partition wall separating the first end from the second end, one or more airflow openings, and a first air duct and a second air duct each coupled to at least one of the one or more airflow openings. An engine mounts in the enclosure toward the first end from the partition wall with the engine comprising an engine cooling fan fluidly coupled to the first air duct. An alternator driven by the engine mounts in the enclosure toward the second end from the partition wall with the alternator comprising an alternator cooling fan fluidly coupled to the second air duct. The engine cooling fan preferably faces the first end to drive engine cooling air received from the first air duct toward the first end, and the alternator cooling fan preferably faces the second end to drive alternator cooling air received from the second air duct toward the second end.

According to another embodiment of the invention, a multi-chamber standby generator includes a multi-chamber generator enclosure having a partition wall that may form at least a first chamber and a second chamber, the first chamber and the second chamber each comprising an air inlet and an air outlet. A first air duct couples to the air inlet of the first chamber and a second air duct couples to the air inlet of the second chamber. An air-cooled engine is located in the first chamber with the air-cooled engine comprising an engine cooling fan coupled to the air inlet of the first chamber by the first air duct, and an alternator driven by the air-cooled engine is located in the second chamber with the alternator comprising an alternator cooling fan coupled to the air inlet of the second chamber by the second air duct.

According to yet another embodiment of the invention, a generator includes a generator enclosure having a first end and a second end opposite the first end, the generator enclosure including a plurality of airflow openings with an airflow opening in the first end and an airflow opening in the second end. An engine and an alternator driven by the engine mount in the enclosure, the engine and alternator mount in a horizontal crankshaft orientation with the engine positioned toward the first end of the enclosure and the alternator positioned toward the second end of the enclosure. An engine cooling fan may be driven by the engine and positioned on a side of the engine opposite from the first end of the enclosure, and an alternator cooling fan may be coupled to the alternator and driven by the engine with the alternator cooling fan positioned on a side of the alternator opposite from the first end of the enclosure. An exhaust side of the engine cooling fan preferably faces the first end of the enclosure and an exhaust side of the alternator cooling fan preferably faces the second end of the enclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A standby generator comprising:

a standby generator enclosure having a first end and a second end opposite the first end, the standby generator enclosure comprising:

a partition wall separating the first end from the second end, one or more airflow openings, and a first air duct and a second air duct each coupled to at least one of the one or more airflow openings;

an engine mounted in the enclosure toward the first end from the partition wall, the engine comprising an engine cooling fan fluidly coupled to the first air duct; and an alternator driven by the engine and mounted in the enclosure toward the second end from the partition wall, the alternator comprising an alternator cooling fan fluidly coupled to the second air duct;

wherein the engine cooling fan faces the first end to drive engine cooling air received from the first air duct toward the first end, and the alternator cooling fan faces the second end to drive alternator cooling air received from the second air duct toward the second end.

2. The standby generator of claim 1 further comprising one or more engine exhaust pipes operatively coupled to the engine and extending therefrom toward the first end and away from the engine cooling fan.

3. The standby generator of claim 2 further comprising:

a muffler coupled to at least one of the one or more engine exhaust pipes, and a muffler box surrounding the muffler and having an opening in a flow path downstream from the engine cooling fan.

4. The standby generator of claim 1 wherein the engine cooling fan is mounted to the engine on a side of the engine opposite from the first end, and the alternator cooling fan is mounted to the alternator on a side of the alternator facing the second end.

5. The standby generator of claim 1 wherein the enclosure further comprises a third air duct coupled to at least one of the one or more airflow openings and to either a fuel and air mixer or a carburetor operatively coupled to the engine.

6. The standby generator of claim 1 wherein the partition wall separates the enclosure into at least two chambers, with the engine and the alternator mounted in separate chambers; and wherein the at least two chambers substantially separate the engine cooling air from the alternator cooling air.

7. The standby generator of claim 1 further comprising an airflow opening in the first end of the enclosure through which the engine cooling air exits the enclosure, and an airflow opening in the second end of the enclosure through which the alternator cooling air exits the enclosure.

8. A multi-chamber standby generator comprising:

a multi-chamber generator enclosure comprising a partition wall that forms at least a first chamber and a second chamber, the first chamber and the second chamber each comprising an air inlet and an air outlet;

a first air duct coupled to the air inlet of the first chamber;

a second air duct coupled to the air inlet of the second chamber;

an air-cooled engine located in the first chamber, the air-cooled engine comprising an engine cooling fan coupled to the air inlet of the first chamber by the first air duct; and an alternator driven by the air-cooled engine and located in the second chamber, the alternator comprising an alternator cooling fan coupled to the air inlet of the second chamber by the second air duct.

9. The multi-chamber standby generator of claim 8 wherein the alternator is mounted to the air-cooled engine in a spaced relationship, with the first air duct and the second air duct extending between the alternator and the air-cooled engine.

10. The multi-chamber standby generator of claim 9 wherein the air inlet of the first chamber and the air inlet of the second chamber are in a back wall of the multi-chamber generator enclosure; and wherein the air outlet of the first chamber and the air outlet of the second chamber are in opposite end walls of the multi-chamber generator enclosure between a front wall and the back wall.

11. The multi-chamber standby generator of claim 8 wherein the air-cooled engine and alternator are mounted in a horizontal crankshaft orientation;

wherein the engine cooling fan drives cooling air through the air-cooled engine in a direction away from the alternator, and wherein the alternator cooling fan draws cooling air through the alternator in a direction away from the air-cooled engine.

12. The multi-chamber standby generator of claim 11 wherein the engine cooling fan drives the cooling air driven through the air-cooled engine out through the air outlet of the first chamber, and the alternator cooling fan drives the cooling air drawn through the alternator out through the air outlet of the second chamber.

13. The multi-chamber standby generator of claim 12 further comprising an exhaust system operatively coupled to the air-cooled engine and extending from the air-cooled engine in a direction downstream from the engine cooling fan.

14. A generator comprising:

a generator enclosure comprising a first end and a second end opposite the first end, the generator enclosure comprising a plurality of airflow openings that includes an airflow opening in the first end and an airflow opening in the second end;

an engine and an alternator driven by the engine mounted in the enclosure, the engine and alternator mounted in a horizontal crankshaft orientation with the engine positioned toward the first end of the enclosure and the alternator positioned toward the second end of the enclosure;

an engine cooling fan driven by the engine and positioned on a side of the engine opposite from the first end of the enclosure; and an alternator cooling fan coupled to the alternator and driven by the engine, the alternator cooling fan positioned on a side of the alternator opposite from the first end of the enclosure;

wherein an exhaust side of the engine cooling fan faces the first end of the enclosure and an exhaust side of the alternator cooling fan faces the second end of the enclosure.

15. The generator of claim 14 further comprising an exhaust system operatively coupled to the engine extending from the engine toward the first end, the exhaust system comprising a muffler at least partially enclosed in a heat shield that funnels cooling air expelled from the engine over the muffler.

16. The generator of claim 15 wherein the engine comprises one or more cylinders and corresponding cylinder heads each comprising a plurality of cooling fins; and wherein the engine cooling fan drives cooling air toward the exhaust system and through the plurality of cooling fins in each of the one or more cylinders and corresponding cylinder heads.

17. The generator of claim 14 further comprising a combustion intake air duct extending from at least one of the airflow openings to either a carburetor or a fuel and air mixer of the engine.

18. The generator of claim 14 further comprising a first air duct and a second air duct each coupled to at least one of the airflow openings, with the first air duct coupled to the engine to provide a cooling air flow path from the respective at least one airflow opening to the engine cooling fan, and with the second air duct coupled to the alternator to provide a separate cooling air flow path from the respective at least one airflow opening to the alternator cooling fan.

19. The generator of claim 18 wherein each at least one airflow opening coupled to the first air duct and the second air duct is formed in a same enclosure wall of the generator enclosure.

20. The generator of claim 18 wherein the first air duct is positioned between the alternator and the engine with a common shaft extending through the first air duct driving the alternator, the first air duct having an airflow opening around the shaft in fluid communication with the engine cooling fan; and wherein the second air duct couples to an airflow opening in a side of the alternator in fluid communication with the alternator cooling fan.

21. The generator of claim 14 further comprising a partition wall separating the enclosure into at least two airflow chambers, with the engine and the alternator mounted in separate airflow chambers.

* * * * *